US007470416B2

(12) United States Patent
Ishida

(10) Patent No.: US 7,470,416 B2
(45) Date of Patent: Dec. 30, 2008

(54) CONDUCTIVE FINE PARTICLES AND ANISOTROPIC CONDUCTIVE MATERIAL

(75) Inventor: Hiroya Ishida, Kouka (JP)

(73) Assignee: Sekisui Chemical Co., Ltd., Osaka (JP)

( * ) Notice: Subject to any disclaimer, the term of this patent is extended or adjusted under 35 U.S.C. 154(b) by 155 days.

(21) Appl. No.: 11/660,537

(22) PCT Filed: Aug. 19, 2005

(86) PCT No.: PCT/JP2005/015130

§ 371 (c)(1),
(2), (4) Date: Feb. 20, 2007

(87) PCT Pub. No.: WO2006/019154

PCT Pub. Date: Feb. 23, 2006

(65) Prior Publication Data

US 2007/0281161 A1 Dec. 6, 2007

(30) Foreign Application Priority Data

Aug. 20, 2004 (JP) ..... 2004-241572

(51) Int. Cl.
*B32B 5/16* (2006.01)

(52) U.S. Cl. ..... 423/403; 252/512

(58) Field of Classification Search ..... 428/403, 428/570; 252/512

See application file for complete search history.

(56) References Cited

U.S. PATENT DOCUMENTS 6,770,369 B1 * 8/2004 Oyamada et al. ..... 428/403
7,291,393 B2 * 11/2007 Wakiya et al. ..... 428/403
2002/0014615 A1 2/2002 Yamada et al.

FOREIGN PATENT DOCUMENTS

| | | | |
|---|---|---|---|
| JP | 08-055514 | * | 2/1996 |
| JP | 2000-195339 | | 7/2000 |
| JP | 2000-243132 | | 9/2000 |
| JP | 2003-234020 | | 8/2003 |
| JP | 2004-035293 | | 2/2004 |
| JP | 2005-044773 A | | 2/2005 |
| JP | 2006-216388 | * | 8/2006 |

* cited by examiner

*Primary Examiner*—H. T Le
(74) *Attorney, Agent, or Firm*—Cheng Law Group PLLC

(57) ABSTRACT

Conductive fine particles which prevent a leak current from being caused by conductive fine particles as a result of fine-pitched electrodes and are low in connection resistance and excellent in conduction reliability, and an anisotropic conductive material using the conductive fine particles. The conductive fine particles have the surfaces of base material fine particles covered with conductive films, with the conductive films provided on the surfaces thereof with swelling protrusions, wherein the swelling protrusions have an average height of at least 50 nm, the portions of swelling protrusions consist of, as a core material, conductive materials different from those of the conductive films, and the outer peripheries of the conductive fine particles are provided with insulating coating layers or insulating fine particles, preferably the thickness of the insulating coating layers being at least 0.2 nm, preferably an average particle size of the insulating fine particles being at least 30 nm and up to an average height of the protrusions; and the anisotropic conductive material having the conductive fine particles dispersed in its resin binder.

8 Claims, 1 Drawing Sheet

[FIG. 1]
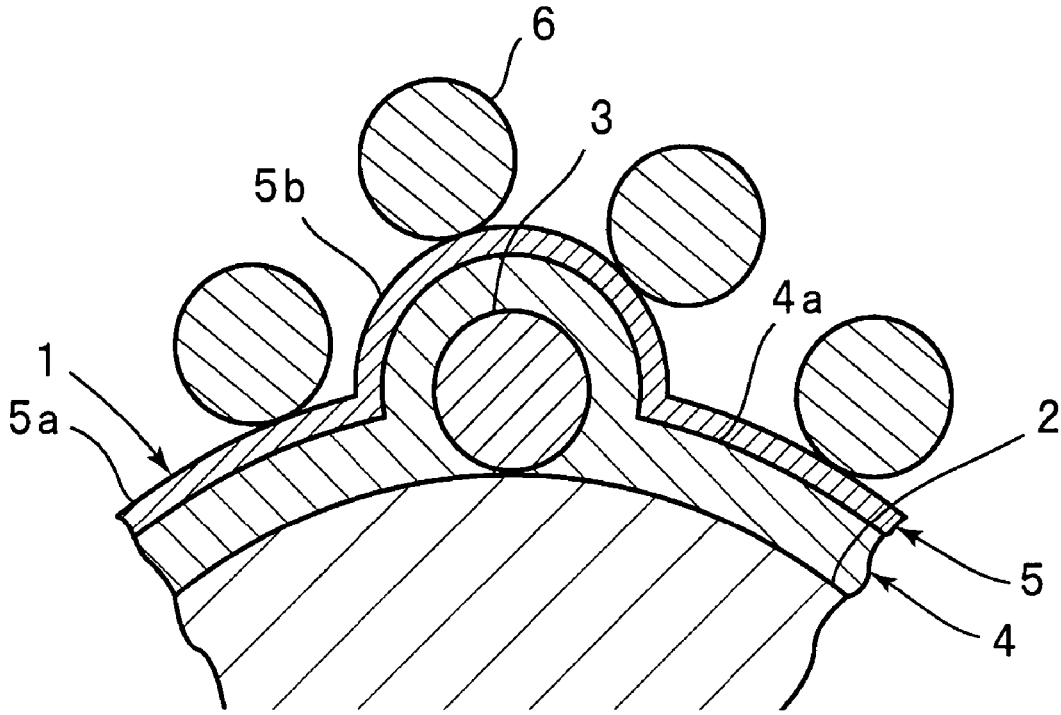

CONDUCTIVE FINE PARTICLES AND ANISOTROPIC CONDUCTIVE MATERIAL

TECHNICAL FIELD

The present invention relates to conductive fine particles which are low in connection resistance, and have small variation in conductivity of particles, and excellent in conduction reliability, and to an anisotropic conductive material using the conductive fine particles.

BACKGROUND ART

Conductive fine particles are widely used as anisotropic conductive materials such as anisotropic conductive paste, anisotropic conductive ink, anisotropic conductive adhesive, anisotropic conductive film, and anisotropic conductive sheet by being mixed or kneaded with binder resin, adhesives and the like.

These anisotropic conductive materials are used while being sandwiched between opposing substrates or electrode terminals, for example, for electrically connecting the substrates, or for electrically connecting a small part such as a semiconductor device to a substrate, in electronic devices such as a liquid crystal display, a personal computer, and a cellular phone.

As the conductive fine particles used in such anisotropic conductive materials, conductive fine particles in which metal plating layers are formed as conductive films on the surfaces of non-conductive fine particles such as resin fine particles having uniform particle size and appropriate strength have been conventionally used. However, with the recent rapid advance and development in electronic devices, there arises a need to further reduce connection resistance of conductive fine particles used as an anisotropic conductive material.

In order to reduce the aforementioned connection resistance of conductive fine particles, conductive fine particles having protrusions on the surface are reported (see Patent document 1, for example). Also, conductive fine particles having protrusions on the surface and provided with an insulation layer on the circumference of particle are reported (see Patent document 2, for example).

Patent document 1 discloses the conductive fine particles in which micro protrusions are formed on metal plated surface by use of abnormal deposition phenomenon in plating reaction when electroless metal plating is affected on the surface of resin fine particles. Since the protrusions have almost the same hardness as that of electrodes, there is little possibility that the protrusions break the electrodes. However, with respect to protrusions formed by the abnormal deposition phenomenon method, since protrusions are formed according to plating condition, it is difficult to sufficiently ensure the conductivity because there is limitation in density and size for providing protrusions having enough adhesiveness to crash through the binder resin of an anisotropic conductive film.

Therefore, in order to ensure high connection reliability, it is necessary to increase a blending amount of conductive fine particles in an anisotropic conductive material. However, increase in the blending amount will result in horizontal conduction between adjacent conductive fine particles, for example, in a substrate having fine wiring, which may cause the problem of occurrence of short between adjacent electrodes. In particular, leak current caused by conductive fine particles becomes problematic as pitch of electrode becomes finer in recent years.

Patent document 2 discloses conductive silica-based particles in which a conductive coating layer is formed on silica-based base particles having protrusions in the entire face of base particles, and having different hardness from the protrusions, and conductive fine particles further formed with an insulation layer on outer peripheries of the silica-based particles. However, since silica particles used in the base particles and protrusions are hard, there is a fear that pressure at the time of pressure bonding may break electrodes when such particles are used as an anisotropic conductive material such as anisotropic conductive film.

Patent document 1: Japanese Unexamined Patent Application No. 2000-243132

Patent document 2: Japanese Unexamined Patent Application No. 2004-35293

DISCLOSURE OF THE INVENTION

In view of the current status of art, it is an object of the present invention to provide conductive fine particles which prevent a leak current from being caused by the conductive fine particles as a result of fine-pitched electrodes, and are low in connection resistance, and excellent in conduction reliability. It is also an object of the present invention to provide an anisotropic conductive material using the conductive fine particles, which prevents a leak current, and is low in connection resistance, and excellent in conduction reliability.

In order to achieve the above object, in a broader aspect of the present invention, the conductive fine particles in which surfaces of the base fine particles are coated with conductive films, which have swelling protrusions on the surface, wherein the swelling protrusions have an average height of 50 nm or more, a core material of the swelling protruding portion is formed of a conductive substance which is different from that of the conductive film, and outer peripheries of the conductive fine particles are provided with insulating coating layers or insulating fine particles, are provided.

In one specific aspect of the present invention, outer peripheries of the conductive fine particles are formed with the insulating coating layers, and the insulating coating layers have a thickness of at least 0.2 nm.

In another aspect of the present invention, outer peripheries of the conductive fine particles is formed with the insulating fine particles, and average particle size of the insulating fine particles is at least 30 nm and up to an average height of protrusion.

In a further specific aspect of the present invention, the conductive core material is in the form of mass or particle, the conductive film has a plated coating, and protrusions swelling on the surface of the plated coating are provided.

In still another specific aspect of the present invention, at least 80% of the conductive core material is on the surfaces of the base fine particles reside in contact with or at a distance of 5 nm or less from the base fine particles.

In a still further specific aspect of the present invention, the conductive core material is formed of at least one kind of metal.

In a still further specific aspect of the present invention, as the conductive film, outermost surfaces are formed by conductive films made of gold.

In other specific aspect of the present invention, an anisotropic conductive material which comprises the conductive fine particles of the present invention dispersed in a resin binder is provided.

In the following, the details of the present invention will be explained.

In conductive fine particles of the present invention, surface of the base fine particles is coated with a conductive film, and the conductive film has protrusions swelling on the surface thereof.

Metal constituting the conductive film is not particularly limited, and examples of such metal include metal such as gold, silver, copper, platinum, zinc, iron, lead, tin, aluminum, cobalt, indium, nickel, chromium, titanium, antimony, bismuth, germanium, and cadmium; and alloys consisting of two or more kinds of metal such as tin-lead alloy, tin-copper alloy, tin-silver alloy, and tin-lead-silver alloy. Among these, nickel, copper, silver, gold and the like are particularly preferred.

A method of forming the conductive film is not particularly limited, and electroless plating, electroplating, sputtering and the like can be exemplified. When the base fine particles are nonconductive such as resin fine particles, a formation method using electroless plating is preferably used. Among these, electroless nickel plating is more preferably used. The metal constituting the conductive film may also contain phosphorus component which is nonmetallic component. When the conductive film is a plated coating, the phosphorous component is relatively generally contained in a plating solution. The metal constituting the conductive film may include other nonmetallic component. For example, a boron component and the like may be contained.

Film thickness of the conductive film is preferably in the range of 10 to 500 nm. If the film thickness is less than 10 nm, desired conductivity is difficult to be obtained, whereas if the thickness is more than 500 nm, the conductive film tends to peel due to difference in coefficient of thermal expansion between the base fine particles and the conductive film.

The swelling protrusions in the conductive fine particles of the present invention has an average height of 50 nm or higher, and a core material in the portion of the swelling protrusion is formed of a conductive substance which is different from that of the conductive film.

In other words, the protrusion in the present invention is made of the core material and the conductive film, and appears as a protrusion swelling on the surface of the conductive film.

The protrusion in the present invention has a core material of a conductive substance which is different from that of the conductive film, so that the metal constituting the aforementioned conductive film is regarded as a different substance from the conductive substance constituting the core material. Even if the conductive substance constituting the core material is the same metal as in the conductive film, it is regarded as a different substance when an additive component such as phosphorous component contained therein is not included, or when a different kind of additive component is included. In addition, metal different from that of the conductive film is regarded as a different substance.

As the conductive substance constituting the core material, a metal, metal oxides, a conductive nonmetal such as graphite, conductive polymers such as polyacetylene and the like can be exemplified. Among these, metal is preferred. Metal may be alloy, and thus, the conductive core material of the present invention is preferably formed of at least one kind of metal.

The metal maybe the same or different from the metal constituting the conductive film, and examples of such metal include metal such as gold, silver, copper, platinum, zinc, iron, lead, tin, aluminum, cobalt, indium, nickel, chromium, titanium, antimony, bismuth, germanium, and cadmium ; and alloys consisting of two or more kinds of metal such as tin-lead alloy, tin-copper alloy, tin-silver alloy, and tin-lead-silver alloy Among these, nickel, copper, silver, gold and the like are particularly preferred.

Hardness of the core material is not particularly limited, however, those having moderate hardness which is enough to break through an insulating coating formed on surface of an electrode but is crushed by the electrode, are preferred.

The swelling protrusion in the present invention should have average height of 50 nm or higher.

Since the average height of the protruding portion is 50 nm or higher, excellent connection stability is achieved because the protrusion becomes easy to eliminate a binder resin or the like or break through the insulating coating formed on surface of the electrode when conductive fine particles of the present invention are used as an anisotropic conductive material. In the present invention, a protrusion having the average height of 50 nm or higher which is formable but is difficult to be formed in abnormal deposition in plating reaction is provided.

Furthermore, average height of protruding portion is preferably 0.5 to 25%, more preferably 1.5 to 25%, and still preferably 10 to 17% of average particle size of the conductive fine particles.

The average height of protruding portion depends on the particle size of the core material and the conductive film. When the average height of protruding portion is less than 0.5% of the average particle size of the conductive fine particles, effect of the protrusion is difficult to be obtained, whereas when it is higher than 25%, the protrusion may sink deeply into an electrode and damage the electrode.

The average height of protruding portion is determined by a measurement method using an electron microscopy as will be explained later.

In the conductive fine particles of the present invention, insulating coating layers or insulating fine particles are provided on the outer peripheries of conductive fine particles.

That is, the conductive fine particles of the present invention are formed by providing insulating coating layers or insulating fine particles on a conductive film having swelling protrusions on its surface. As a result, when connection is achieved by using such conductive fine particles as an anisotropic conductive material, conductive fine particles which is low in connection resistance and excellent is conduction reliability can be obtained because the insulating coating layers or the insulating fine particles prevent a leak current between adjacent particles, and the protrusion helps elimination of binder resin or the like and allows desirable connection with an electrode.

The coating in which insulating fine particles coat in the form of laminate forms an insulating coating layer of the insulating fine particles and is thus called "insulating coating layer".

The material of the above insulating coating layers or the insulating fine particles is not particularly limited insofar as it has insulation property, and for example, resin having insulation property is preferably used.

Examples of the resin having insulation property include epoxy resin, polyolefin resin, acrylic resin, styrene resin and the like.

In the conductive fine particles of the present invention, when the outer peripheries of the conductive fine particles are provided with the insulating coating layers, thickness of an insulating coating layer is preferably at least 0.2 nm.

When thickness of an insulating coating layer is less than 0.2 nm, the effect of keeping insulation and preventing a leak current between adjacent particles decreases. An upper limit of thickness of the insulating coating layer is preferably 10% or less of the average particle size of the base fine particles in order to keep the uniformity of particle size of the conductive fine particles.

In the conductive fine particles of the present invention, when the outer peripheries of the conductive fine particles is provided with insulating fine particles, the average particle size of the insulating fine particles is preferably at least 30 nm and up to the average height of the protrusion.

When the average particle size of the insulating fine particles is less than 30 nm, the effect of keeping insulation and preventing a leak current between adjacent particles decreases. When the average particle size of the insulating fine particles exceeds the average height of protrusion, the effect of the protrusion to help elimination of binder resin or the like and to achieve desirable connection with electrode decreases.

The shape of protrusion in the present invention is not particularly limited, however, it will depend on the shape of the core material because the conductive film envelopes and covers the core material.

The shape of the core material is not particularly limited, however, it is preferably in the form of mass or particle.

Examples of the mass form include, particulate mass, aggregation mass formed by aggregation of plural fine particles, and amorphous mass.

Examples of the particulate form include spherical, disc, columnar, plate-like, needle-like, cube, and rectangular solid.

In the conductive fine particles of the present invention, the conductive core material is in the form of mass or particle, the conductive film is a plated coating, and the surface of the plated coating preferably has a swelling protrusion.

In the present invention, adhesiveness between a protrusion and a base fine particle depends on the particle size of the core material and the conductive film, and the thicker conductive film the core material is coated with, the better the protrusion is because it becomes more difficult to get off.

Taking longest outer diameter of core material as X and film thickness of conductive film as Y, X/Y ratio is preferably from 0.5 to 5. It is desirable to select size of core material and film thickness of conductive film so that X/Y ratio falls within the above range.

Density of protrusions in the present invention is important because it greatly influences on performance of the conductive fine particles of the present invention.

The density of protrusions, which is represented by the number of the protrusions per one conductive fine particle, is preferably 3 or more. When the density of protrusions is 3 or more, favorable connection state is achieved in the case of using the conductive fine particles of the present invention as an anisotropic conductive material for connection, because protrusions come into contact with an electrode regardless of orientation of the conductive fine particles.

The density of protrusions may readily be controlled, for example, by changing the amount of core material to be added to surface area of the base fine particles.

In the following, the present invention will be explained more specifically.

(Base Fine Particles)

Base fine particles in the present invention is not particularly limited, and may be inorganic materials or organic materials, unless they have appropriate elasticity, elastic deformability and resilience. However, as the basic fine particles, resin fine particles formed of resin are preferred.

The resin fine particles are not particularly limited, and examples thereof may include those formed of, for example, polyolefins such as polyethylene, polypropyrene, polystyrene, polyvinyl chloride, polyvinylidene chloride, polytetrafluoroethylene, polyisobutylene and polybutadiene; acrylic resins such as polymethyl metacrylate and polymethyl acrylate; copolymeric resin of acrylate and divinyl benzene, polyalkylene terephthalate, polysulfone, polycarbonate, polyamide, phenolformaldehyde resin, melamineformaldehyde resin, benzoguanamine formaldehyde resin, and urea formaldehyde resin. These resin fine particles may be used singly or in combination of two or more kinds.

The average particle size of the base fine particles is preferably 1 to 20 μm, more preferably 1 to 10 μm. When the average particle size is less than 1 μm, aggregation is likely to occur, for example, in electroless plating, which may make it difficult to provide a single particle. When it is more than 20 μm, it may be outside the range accepted for an anisotropic conductive material for use between substrate electrodes or the like.

(Method of Forming Protrusion)

A method of forming a protrusion swelling on the surface of the conductive film in the present invention is not particularly limited, and for example, a method of adhering a core material on the surface of base fine particles and coating with the conductive film by electroless plating; a method of coating surface of base fine particles with a conductive film by electroless plating, adhering a core material, and further coating with a conductive film by electroless plating; and a method of coating with a conductive film by sputtering instead of electroless plating in the above method can be exemplified.

As the method of adhering a core material on the surface of the base fine particles, for example, a method of adding a conductive substance which is to be the core material to dispersion of the base fine particles and accumulating and adhering the core material on the surface of the base fine particles, for example, by van der Waals force; and a method of adding a conductive substance which is to be the core material to a container containing base fine particles and adhering the core material to surface of the base fine particles by mechanical action such as rotation of the container can be exemplified. Among these, the method of accumulating and adhering a core material on the surface of base fine particles in dispersion is preferably used because of ease of control of the amount of core material to be adhered.

In the method of accumulating and adhering a core material on the surface of base fine particles in dispersion, more specifically, it is preferred to use a core material having 0.5 to 25% particle size relative to the average particle size the base fine particles. More preferably, the particle size is 1.5 to 15%. Further, in consideration of dispersibility of core material into a dispersion medium, specific gravity of the core material is preferably as small as possible. Furthermore, in order to prevent significant changes in surface charges of the base fine particles and the core material, it is preferred to use deionized water as a dispersion medium.

In the conductive fine particles of the present invention, at least 80% of conductive core material residing on surface of the base fine particles preferably resides in contact with base fine particles or at a distance of 5 mm or less from the base fine particles.

Since the conductive core material locates in close to a base fine particle, the core material is securely coated, for example, with a plated coating, and conductive fine particles in which adhesion of swelling protrusions to base fine particles is excellent can be produced. Further, since the core material locates in close to a base fine particle, protrusions can be aligned on surface of the base fine particle. In addition, the size of core material is easy to be uniformized, and conductive fine particles in which a height of swelling protrusion is uniform on surface of base fine particles can be readily obtained. Therefore, when the above conductive fine particles are used as an anisotropic conductive material for connection between electrodes, variation in conductivity between conductive fine particles can be made small and an advantage of excellent conduction reliability is obtained.

(Gold Layer)

Preferably, the conductive fine particles of the present invention are formed with a conductive film having an outermost surface made from a gold layer.

By making the outermost surface of the conductive film from a gold layer, it is possible to reduce connection resistance or stabilize the surface.

When the entire conductive film in the present invention is made of gold, the aforementioned reduction in connection resistance or stabilization of surface may be achieved without necessity of newly forming a gold layer.

When the outermost surface is made from a gold layer, the outermost surface of the swelling protruding portion in the present invention may be made from a gold layer, and the entire protruding portion may be made of gold.

The gold layer may be formed by a known method such as electroless plating, immersion plating, electroplating or sputtering.

Thickness of the gold layer is not particularly limited, however it is preferably 1 to 100 nm, and more preferably 1 to 50 nm. When it is less than 1 nm, prevention of oxidation of an underlying nickel layer may become difficult, for example, and connection resistance may increase. If it is more than 100 nm, the gold layer formed by immersion plating, for example, may erode the underlying nickel layer and hinder adherence between base fine particles and the underlying nickel.

FIG. 1 is a partially cutaway front section view schematically showing a portion having a swelling protrusion in a conductive fine particle according to one embodiment of the present invention. As shown in FIG. 1, on surface of a base fine particle 2 of a conductive fine particle 1, a particulate core material 3 adheres. The base fine particle 2 and the core material 3 are coated with a plated coating 4. Surface 4*a* of the plated coating 4 is coated with a gold layer 5. In surface 5*a* of the outer most surface of gold layer 5, the gold layer 5 has a protrusion 5*b* swelled by the core material 3. To the outer circumferential face of the conductive fine particle 1, a plurality of insulating fine particles 6 adhere.

(Electroless Plating)

Formation of a conductive film in the present invention may be achieved, for example, by electroless plating method. As a method of conducting the electroless nickel plating includes immersing a base fine particle added with a catalyst in a bath, which is made and is warmed, for example, contents of which is an electroless nickel plating solution containing sodium hypophosphite as a reducing agent in accordance with a predetermined method, and allowing deposition of a nickel layer through a reductive reaction shown by: $Ni^{2+}+H_2PO_2^-+H_2O \rightarrow Ni_2+H_2PO_3^-+2H^+$.

As the method of adding a catalyst, a method of conducting an electroless plating pretreatment including alkaline degreasing, acid neutralization, sensitizing in tin dichloride (SnCl) solution, and activating in palladium dichloride (PdCl) solution on resin base fine particles can be exemplified. Sensitizing is a process of making $Sn^{2+}$ ion be adsorbed to surface of the insulation substance, and activating is a process of causing a reaction of $Sn^{2+}+Pd^{2+} \rightarrow Sn^{4+}+Pd^0$ on surface of the insulation substance to make palladium into a catalyst core of electroless plating.

In making a core material adhere on surface of a base fine particle, it is preferred that palladium is present on surface of the base fine particle. In other words, in a conductive fine particle of the present invention, it is preferred that a core material is adhered to a base fine particle in which palladium is present on the surface to give a fine particle with protrusion, and the fine particle with protrusion is coated with a plated coating by electroless plating originating from palladium.

(Formation of Insulating Coating Layers or Insulating Fine Particles)

A method of forming an insulating coating layer on conductive fine particles having protrusions on the surface is not particularly limited, and for example, a method of dispersing conductive fine particles in a resin dispersion solution, followed by coating with resin by heat drying or spray drying; a method of conducting interfacial polymerization, suspension polymerization, emulsion polymerization and the like in the presence of conductive fine particles, thereby microcapsulating the conductive fine particles with resin; or a method of forming an origin which is chemically bonded on surface of conductive fine particles with a polymerization initiator having a functional group capable of binding to metal surface or with a reactive monomer, and allowing a graft polymer chain to grow from the origin can be exemplified.

Among these, the method of forming an origin by chemically bonding on the surface of the conductive fine particles with a polymerization initiator or reactive monomer having a functional group capable of binding to metal surface, and allowing a graft polymer chain to grow from the origin is particularly preferred.

The method of forming an origin which is chemically bonded on surface of conductive fine particles with a polymerization initiator having a functional group capable of binding to metal surface or with a reactive monomer, and allowing a graft polymer chain to grow from the origin may be achieved, for example, by mixing a polymerization initiator having a thiol group or a vinyl monomer having a thiol group with conductive fine particles to prepare particles in which polymerization origin is formed by reacting and chemically bonding a thiol group with metal surfaces, and causing polymerization by dispersing the particles into a polymerization solution containing the vinyl monomer. Here, as the vinyl monomer, acrylic acid ester, styrene and the like can be exemplified.

Further, the method of forming insulating fine particles on conductive fine particles having protrusions on the surface is not particularly limited, and, for example, a method of adhering fine resin fine particles by high speed stirrer or hybridization; a method of electrostatically adhering resin fine particles to conductive fine particles; a method of electrostatically adhering resin fine particles to conductive fine particles and chemically bonding the resin fine particles to metal surface of the conductive fine particles using a silane coupling agent; and a method of adhering fine resin particles on surface of conductive fine particles in a liquid, followed by chemical binding to surface of conductive fine particles can be exemplified.

Among these, the method of electrostatically adhering resin fine particles to conductive fine particles; the method of electrostatically adhering resin fine particles to conductive fine particles and chemically bonding the resin fine particles to metal surface of the conductive fine particles using a silane coupling agent; and the method of adhering fine resin particles on surface of conductive fine particles in a liquid, followed by chemical binding to surface of conductive fine particles are preferred.

Since there is no fear that conductive fine particles are damaged in formation of insulating fine particles, and not only an adhesion amount of insulating fine particles but also an exposed area of metal surface of conductive fine particles can be controlled by appropriate setting, the method of adhering fine resin fine particles on the surface of conductive fine particles in a liquid, followed by chemical binding to surface of conductive fine particles is particularly preferred.

The method of electrostatically adhering resin fine particles to conductive fine particles may be achieved, for example, by first charging resin fine particles by a discharge device, and mixing the charged resin fine particles with conductive fine particles by stirring.

The method of electrostatically adhering resin fine particles to conductive fine particles and chemically bonding the resin fine particles to metal surface of the conductive fine particles using a silane coupling agent may be achieved, for example, by first charging resin fine particles by a discharge device, mixing the charged resin fine particles with conductive fine particles by stirring, and adding a silane coupling agent to the mixture of resin fine particles and conductive fine particles, thereby making the resin fine particles to be firmly adhered to the conductive fine particles. Examples of the silane-coupling agent include epoxy silane, amino silane, vinyl silane and the like.

As the aforementioned method of adhering fine resin fine particles on the surface of conductive fine particles in a liquid, followed by chemical binding to the surface of conductive fine particles, a so-called hetero aggregation method can be exemplified in which after aggregating resin fine particles to conductive fine particles by van der Waals force or electrostatic interaction, in an organic solvent and/or water which does not dissolve at least resin fine particles, the conductive fine particles and the resin fine particles are chemically bonded. According to this method, since the chemical reaction between the conductive fine particles and the insulating fine particles proceeds rapidly and securely owing to solvent effect, there is no fear that the conductive fine particles will be broken by pressure or heating at high temperature. Further, since reaction temperature is readily controlled, the adhered resin fine particles will not be deformed by heat.

As a method of chemically adhering resin fine particles to conductive fine particles, a method of binding resin fine particles having a functional group (A) which is capable of forming an ion bond, a covalent bond, or a coordinate bond with metal on the surface thereof, to the surface of the conductive fine particles; and a method of introducing a compound having the functional group (A) and a functional group (B) which is reactive to a functional group on the surface of resin fine particles into the metal surface of conductive fine particles, and then reacting the functional group (B) with the resin fine particles in a single-step or multi-step reaction to bind be exemplified.

Examples of the functional group (A) include a silane group, a silanol group, a carboxyl group, an amino group, an ammonium group, a nitro group, a hydroxyl group, a carbonyl group, a thio group, a sulfonic acid group, a sulfonium group, a boric acid group, an oxazoline group, a pyrrolidone group, a phosphoric acid group, a nitrile group and the like can be exemplified. Among these, functional groups capable of forming a coordinate bond are preferred, and functional groups having S, N, and P atoms are preferably used. When metal is gold, for example, a functional group having S atom which forms a coordinate bond with gold, in particular, a thiol group or a sulfide group is preferred. These functional groups can be obtained by using vinyl polymerization particles copolymerized from a polymerizable vinyl monomer having such a functional group, on the surface of the resin fine particles. It may be obtained by reacting with a compound having the functional group (B) which is reactive to a functional group on the surface of resin fine particles and the above functional group (A) by using resin fine particles having a functional group in their surfaces or by using a functional group introduced by modifying surfaces of resin fine particles.

Also, surfaces of resin fine particles may be chemically treated and modified to the functional group (A), and a method of modifying surfaces of resin fine particles to the functional group (A) by plasma or the like is also exemplified.

Further, as a compound having the functional group (A) and the reactive functional group (B), for example, 2-aminoethanethiol, p-aminothiophenol and the like can be exemplified. In particular, by binding 2-aminoethanethiol to the surface of conductive fine particles via SH groups, and reacting one of amino groups with resin fine particles having, for example, an epoxy group or a carboxyl group on their surface, it is possible to bind conductive fine particles with resin fine particles.

According to the conductive fine particles of the present invention, since the conductive film encloses and covers the core material which is a conductive substance, the protruding portion shows excellent conductivity. Therefore, in the conductive fine particles of the present invention, since there are protrusions having excellent conductivity in the surface of the conductive film, binder resin or the like is readily eliminated and reliable conduction is established and an effect of reducing connection resistance is obtained when the conductive fine particles are uses as an anisotropic conductive material for connecting electrodes.

Furthermore, when a conductive substance in the form of mass or particle in which the core material has uniform size is used, protruding portions of uniform height are obtained. Therefore, conductive fine particles which are low in connection resistance, have small variation in conductivity of conductive fine particles, are excellent in conduction reliability can be obtained.

Furthermore, since the conductive fine particles of the present invention are provided with insulating coating layers or insulating fine particles on their surface, when they are used as an anisotropic conductive material, it is possible to prevent a leak current from occurring between adjacent particles.

Furthermore, when metal surface of conductive fine particles and insulating fine particles are chemically bonded, the insulating fine particles will not fall off due to too small binding force with the metal surface of the conductive fine particles, when they are kneaded into binder resin or the like or when they come into contact with adjacent particles. Further, since the chemical bond is formed only between the metal surface of the conductive fine particles and the insulating fine particles, and the insulating fine particles can not bind with each other, the insulating fine particles form a single coating layer, the particle size distribution of insulating fine particles is small, and a contact area between an insulating fine particle and a metal surface is uniform. Therefore, particle size of conductive fine particles can be uniformized.

Further, as described above, since the conductive fine particles have protrusions, even if insulating coating layers or insulating fine particles firmly adhere, the protrusions push the insulating coating layers or the insulating fine particles away by thermal compression bond, enabling secure conductive connection.

(Method of Measuring Characteristics)

Various characteristics of conductive fine particles in the present invention, for example, film thickness of conductive film, film thickness of gold layer, thickness of insulating coating layer, average particle size of insulating fine particles, average particle size of base fine particles, average particle size of conductive fine particles, shape of core material, longest outer diameter of core material, shape of protrusion, average height of protruding portion, density of protrusions and the like may be determined by observing particles or cross sections of conductive fine particles under electron microscopy.

As a preparation method of a sample to be subjected to the above cross section observation, a method can be exemplified which includes embedding conductive fine particles in a thermosetting resin, and curing the resin by heating, and grinding the resultant sample using certain grinding paper or abrading agent until an observable mirror surface is achieved.

Particles of conductive fine particles are observed under a scanning electron microscopy (SEM), and observation is conducted, for example, at 4000-fold magnification, although the magnification may be appropriately selected to facilitate the observation. Cross sections of conductive fine particles are observed under a transmission electron microscope (TEM), and observation is conducted, for example, at 100,000-fold magnification, although the magnification may be appropriately selected to facilitate the observation.

The average film thicknesses of conductive film, gold layer, and insulating coating layer of the above conductive fine particles are film thicknesses obtained by arithmetic averaging of measurements for 10 particles which are selected at random. When film thicknesses of a particular conductive fine particle lacks uniformity, a largest film thickness and a smallest film thickness are measured, and the measurements are arithmetically averaged to determine a film thickness.

The average particle size of insulating fine particles is determined by measuring particle sizes of 50 insulating fine particles which are selected at random and arithmetically averaging the measurements.

The average particle size of base fine particles is determined by measuring particle sizes of 50 base fine particles which are selected at random and arithmetically averaging the measurements.

The average particle size of conductive fine particles is determined by measuring particle sizes of 50 conductive fine particles which are selected at random and arithmetically averaging the measurements.

The average height of protruding portion is determined by measuring height of the part merging as a protrusion from a reference surface forming the outermost surface, for 50 protruding portions which are almost entirely observed in a number of observed protruding portions, and arithmetically averaging the measurements. At this time, a protrusion having a size of 0.5% or more of the average particle size of conductive fine particle is chosen as the one that imparts the effect of adding the protrusion.

Density of protrusions is determined by counting the number of protrusions having a projecting height of preferably 10% or more of the average particle size of conductive fine particles for 50 particles selected at random, and converting the number to a number of protrusions per one conductive fine particle.

(Anisotropic Conductive Material)

An anisotropic conductive material of the present invention is formed by dispersing conductive fine particles of the present invention in a resin binder.

The anisotropic conductive material is not particularly limited unless conductive fine particles of the present invention are dispersed in a resin binder, and for example, anisotropic conductive paste, anisotropic conductive ink, anisotropic conductive adhesive, anisotropic conductive film, anisotropic conductive sheet and the like can be exemplified.

The preparation method of the anisotropic conductive material of the present invention is not particularly limited, and for example, conductive fine particles of the present invention are added into an insulating resin binder and uniformly mixed and dispersed, to give anisotropic conductive paste, anisotropic conductive ink, anisotropic conductive adhesive and the like, or conductive fine particles of the present invention are added to an insulating resin binder, and homogeneously mixed and dispersed to prepare a conductive composition, and then the conductive composition is homogeneously dissolved (dispersed) in an organic solvent as is necessary, or melted by heating, and applied to a mold releasing face of exfoliate material such as exfoliate paper or exfoliate film so as to give a predetermined film thickness, followed by drying or cooling as is necessary, to give an anisotropic conductive film, anisotropic conductive sheet and the like. The preparation method may be appropriately selected depending on the type of anisotropic conductive material to be prepared. The insulating resin binder and the conductive fine particles of the present invention may be separately used without mixing, to prepare an anisotropic conductive material.

The resin of the insulating resin binder is not particularly limited, and for example, vinyl resins such as vinyl acetate resin, vinyl chloride resin, acrylic resin and styrenic resin; thermosetting resins such as polyolefin resin, ethylene-vinyl acetate copolymer and polyamide resin; epoxy resin, urethane resin, acrylic resin, polyimide resin, unsaturated polyester resin and curable resins comprising curing agents thereof; thermosetting block copolymers such as styrene-butadiene-styrene block copolymer, styrene-isoprene-styrene block copolymer, hydrogenated thereof; elastomers (rubbers) such as styrene-butadiene copolymer rubber, chloroprene rubber, acrylonitrile-styrene block copolymer rubber can be exemplified. These resins may be used singly or in combination of two or more kinds. The curative resin may be of any curing types including ambient temperature curable type, thermo curable type, optical curable type, and moisture curable type.

In addition to the insulating resin binder and the conductive fine particles of the present invention, the anisotropic conductive material of the present invention may further contain one or more of additives including expander, flexibilizer (plasticizer), adhesion enhancer, antioxidant (antiaging agent), thermo stabilizer, light stabilizer, ultraviolet absorber, colarant, fire retardant and organic solvent as is necessary in such a degree that does not inhibit achievement of the object of the present invention.

Since the present invention is configured as described above, a leak current by conductive fine particles as a result of fine-pitched electrodes is prevented and hence conductive fine particles with lower connection resistance and excellent conduction reliability can be obtained. Further, it becomes possible to obtain an anisotropic conductive material using such conductive fine particles, which prevent a leak current and are low in connection resistance and excellent in conduction reliability.

According to the present invention, it is possible to prevent a leak current from being caused by conductive fine particles as a result of fine-pitched electrodes, and to provide conductive fine particles which are low in connection resistance and excellent in conduction reliability, and an anisotropic conductive material using the conductive fine particles.

BRIEF EXPLANATION OF DRAWING

FIG. 1 is a partially cutaway front section view schematically showing a portion having a swelling protrusion in a conductive fine particle according to one embodiment of the present invention.

EXPLANATION OF REFERENCE NUMERALS

1 conductive fine particle
2 base fine particle
3 core material
4 plated coating
5 gold layer
6 insulating fine particle

BEST MODE FOR CARRYING OUT THE INVENTION

In the following, the present invention will be explained in more detail with reference to Examples, however, it is to be noted that the present invention is not limited to following Examples.

EXAMPLE 1

(Electroless Plating Pretreatment Step)

10 g of base fine particles formed of a copolymer resin of tetramethylol methane tetraacrylate and divinyl benzene, having an average particle size of 3 μm was subjected to alkaline degreasing by an aqueous sodium hydroxide solution, acid neutralization, and sensitizing in a tin dichloride solution. Then an electroless plating pretreatment comprising activating in a palladium dichloride solution was conducted, and after filtration and washing, base fine particles having palladium adhered to the surface of particles were obtained.

(Core Material Combining Step)

The obtained base fine particles were dispersed in 300 mL of deionized water for 3 minutes under stirring, and the resultant aqueous solution was added with 1 g of metal nickel particle slurry (average particle size of 200nm) over 3 minutes, to obtain base fine particles to which core materials adhere.

(Electroless Nickel Plating Step)

The obtained base fine particles were further diluted in 1200 mL of water, added with 4 mL of a plating stabilizer, and to the resultant aqueous solution, 120 mL of mixture solution of 450 g/L of nickel sulfate, 150 g/L of sodium hypophosphite, 116 g/L of sodium citrate, and 6 mL of plating stabilizer was added at an adding speed of 81 mL/min through a constant rate pump. Then the mixture was stirred until pH stabilizes, and subjected to first stage of electroless plating after checking stop of hydrogen foaming.

Then, 650 mL of mixture solution of 450 g/L of nickel sulfate, 150 g/L of sodium hypophosphite, 116 g/L of sodium citrate, and 35 mL of plating stabilizer was added at an adding speed of 27 mL/min through a constant rate pump. Then the mixture was stirred until pH stabilizes, and subjected to second stage of electroless plating after checking stop of hydrogen foaming.

Then the plating solution was filtrated and the filtered matter was washed with water, and dried in a vacuum dryer at 80° C. to obtain nickel-plated conductive fine particles.

(Gold Plating Step)

Thereafter, the surface is further plated with gold by immersion plating, to obtain gold-plated conductive fine particles.

(Preparation of Insulating Fine Particles)

In a 1000 mL separable flask equipped with a four-neck separable cover, stirring wing, three-way cock, cooling tube, and temperature probe, a monomer composition comprising 50 mmol of glycidyl methacrylate, 50 mmol of methyl methacrylate, 3 mmol of ethylene glycol dimethacrylate, 1 mmol of phenyldimethylsulfonium methacrylate methyl sulfate, and 2 mmol of 2,2'-azobis{2-[N-(2-carboxyethyl)amidino] propane} was weighed into distilled water so that the solid fraction was 5% by weight, and stirred at 200 rpm, and then polymerized for 24 hours at 70° C. under nitrogen atmosphere. After completion of reaction, the particles were lyophilized to obtain insulating fine particles having a sulfonium group and an epoxy group on the surface and an average particle size of 180 nm, CV value of particle size of 7%.

(Preparation of Conductive Fine Particles)

The obtained insulating fine particles were dispersed in acetone under ultrasonic radiation, to obtain 10% by weight of acetone dispersion of insulating fine particles.

10 g of the obtained gold plated conductive fine particles was dispersed in 500 ml of acetone, and added with 4 g of acetone dispersion of insulating fine particles, and stirred for 6 hours at room temperature. Filtration through 3 μm mesh filter was followed by washing with methanol and drying, to obtain conductive fine particles.

COMPARATIVE EXAMPLE 1

Nickel-plated conductive fine particles were obtained in a similar manner as described in Example 1 except that core material combining step was not executed on base fine particles after electroless plating pretreatment step; and in the electroless nickel plating step, the amount of the plating stabilizer added at first was 1 mL rather than 4 mL, and no more plating stabilizer was added later. In the electroless nickel plating step, auto decomposition of plating solution occurred. Thereafter, the surface was plated with gold by immersion plating, and using insulating fine particles obtained in a similar manner as described in Example 1, conductive fine particles were obtained in a similar manner as described in Example 1.

(Evaluation of Conductive Fine Particles)

Conductive fine particles obtained in Example 1 and Comparative example 1 observed with a scanning electron microscopy (SEM) manufactured by Hitachi High-Technologies Corporation.

In the conductive fine particles of Example 1, swelling protrusions, and resin fine particles which are insulating fine particles were observed in the surface of the plated coating.

In the conductive fine particles of Comparative example 1, swelling protrusions were observed in the surface of the plated coating, however, the shape and height of protrusions were not uniform, and the average height of protrusions was low. Resin fine particles which are insulating fine particles were observed.

The average height of protrusions and the average particle size of insulating fine particles in these conductive fine particles are shown in Table 1.

(Evaluation of Anisotropic Conductive Material)

Using conductive fine particles obtained in Example 1 and Comparative example 1, an anisotropic conductive material was prepared, and resistance between electrodes and a leak current between electrodes were evaluated.

As a resin for resin binder, 100 parts by weight of epoxy resin (manufactured by Yuka Shell Epoxy K.K. "Epikote 828"), 2 parts by weight of tris dimethylamino ethyl phenol, and 100 parts by weight of toluene were mixed well using a planetary mixer, and applied on an exfoliate film so that the thickness after drying was 10 μm. Then toluene was dried off to obtain an adhesive film.

Then the obtained conductive fine particles were added to 100 parts by weight of epoxy resin (manufactured by Yuka Shell Epoxy K.K. "Epikote 828") which is a resin binder, 2 parts by weight of tris dimethylamino ethyl phenol, and 100 parts by weight of toluene, mixed well using a sun-and-planet type stirrer, and applied on an exfoliate film so that the thickness after drying was 7 μm. After that, toluene was dried off to obtain an adhesive film containing conductive fine particles. The blending amount of the conductive fine particles was selected so that the content in film was 50,000 particles/$cm^2$.

The obtained adhesive film and the adhesive film containing conductive fine particles were laminated at ambient temperature, to obtain a double-layered anisotropic conductive film having a thickness of 17 μm.

The obtained anisotropic conductive film was cut into a piece of 5×5 mm in size. The piece was attached in substantial center of an aluminum electrode having width of 50 μm, length of 1 mm, height of 0.2 μm, and L/S of 15 μm, provided with drawing wirings on one side for measurement of resistance, and then glass substrates having an identical aluminum electrode were registered so that the electrodes lie on top of the other and joined each other.

The joint of the resultant glass substrate was bonded by thermal compression at a compression condition of 40 MPa and 130° C., and the resistance between electrodes, and a leak current between electrodes were evaluated. The results are shown in Table 1.

TABLE 1

| | Example 1 | Comparative example 1 |
|---|---|---|
| Average Height of Protrusion | 200 nm | 40 nm |
| Average Particle Size of Insulating Fine Particles | 40 nm | 40 nm |
| Resistance Between Electrodes | 4 Ω | 10 Ω |
| Presence of a Leak Current | Not Detected | Not Detected |

The invention claimed is:

1. Conductive fine particles having surfaces of base fine particles coated with conductive films, wherein the conductive films have swelling protrusions on a surface thereof, the swelling protrusions have an average height of 50 rim or higher, a portion of the swelling protrusions consist of, as a core material, a conductive material different from those of the conductive films, and Outer peripheries of the conductive fine particles are provided with insulating coating layers or insulating fine particles.

2. The conductive fine particles according to claim 1, wherein the outer peripheries of the conductive fine particles are formed with the insulating coating layers, and the insulating coating layers have a thickness of at least 0.2 nm.

3. The conductive fine particles according to claim 1, wherein the outer peripheries of the conductive fine particles are formed with the insulating fine particles, and an average particle size of the insulating fine particles is at least 30 rim and up to the average height of the swelling protrusions.

4. The conductive fine particles according to any one of claims 1 to 3, wherein the conductive core material is in the form of mass or particle, the conductive films have plated coatings and protrusions swelling on the surface of the plated coating.

5. The conductive fine particles according to any one of claims 1 to 3, wherein at least 80% of the conductive core material residing on the surfaces of the base fine particles resides in contact with or at a distance of 5 rim or less from the base fine particles.

6. The conductive fine particles according to any one of claims 1 to 3, wherein the conductive core material is formed of at least one kind of metal.

7. The conductive fine particles according to any one of claims 1 to 3, wherein as the conductive films, outermost surfaces are formed by conductive films having made of gold.

8. An anisotropic conductive material comprising the conductive fine particles according to any one of claims 1 to 3 dispersed in a resin binder.

* * * * *